US007950960B2

(12) United States Patent
Olson et al.

(10) Patent No.: US 7,950,960 B2
(45) Date of Patent: May 31, 2011

(54) PRESSED IN CABLE TRANSITION AND METHOD

(76) Inventors: Steven C. Olson, Broomfield, CO (US); Craig S. Leahy, Westminster, CO (US); Chad E. Dewey, Longmont, CO (US)

( * ) Notice: Subject to any disclaimer, the term of this patent is extended or adjusted under 35 U.S.C. 154(b) by 163 days.

(21) Appl. No.: 12/358,515

(22) Filed: Jan. 23, 2009

(65) Prior Publication Data

US 2009/0191753 A1 Jul. 30, 2009

Related U.S. Application Data

(60) Provisional application No. 61/024,272, filed on Jan. 29, 2008.

(51) Int. Cl.
*H01R 9/05* (2006.01)

(52) U.S. Cl. ..... 439/584

(58) Field of Classification Search ..... 333/33, 333/260; 361/742, 758, 770, 804; 439/584
See application file for complete search history.

(56) References Cited

U.S. PATENT DOCUMENTS

| | | | |
|---|---|---|---|
| 2,983,884 | A | 5/1961 | Rueger |
| 3,324,421 | A | 6/1967 | Fujimoto |
| 4,837,529 | A | 6/1989 | Gawronski et al. |
| 5,757,246 | A | 5/1998 | Johnson |
| 5,986,519 | A | 11/1999 | Kellett et al. |
| 6,414,636 | B1 | 7/2002 | Godard et al. |
| 6,922,174 | B2 | 7/2005 | Haunberger et al. |
| 7,008,256 | B2 | 3/2006 | Poiraud |
| 7,207,806 | B2 | 4/2007 | Higgins |
| 2005/0272278 | A1 | 12/2005 | Staniszewski et al. |

*Primary Examiner* — Briggitte R Hammond

(74) *Attorney, Agent, or Firm* — Ancel W. Lewis, Jr.

(57) ABSTRACT

A transition for connecting a coaxial cable to a conductive metal part such as an antenna has a base and a sleeve. The base is pressed into the groundplane of the antenna to provide a permanent conductive and mechanical connection. A low profile transition has a base and a channel portion parallel to the face of the base.

11 Claims, 3 Drawing Sheets

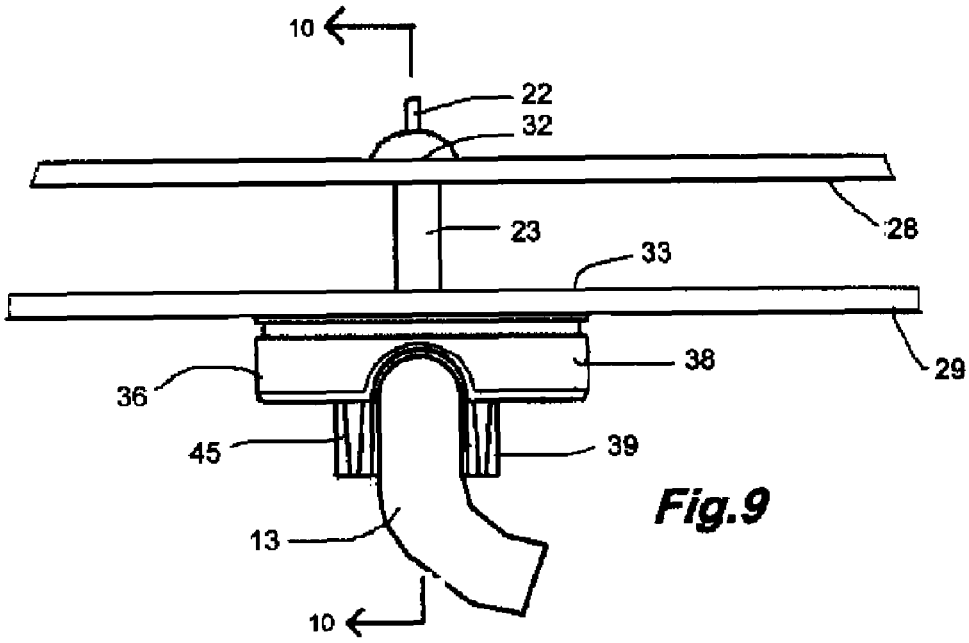
Fig.9
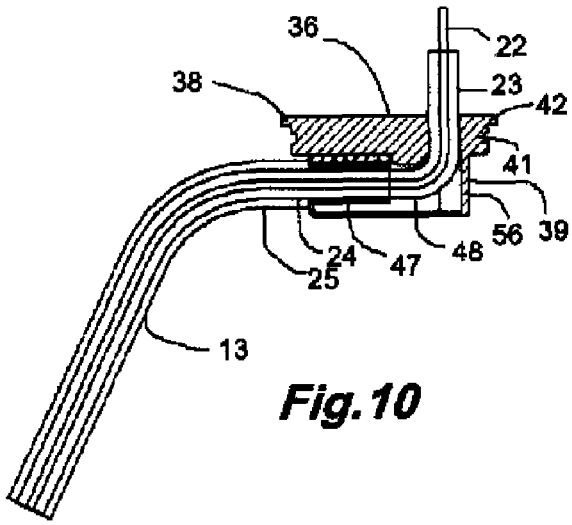
Fig.10
Fig.11
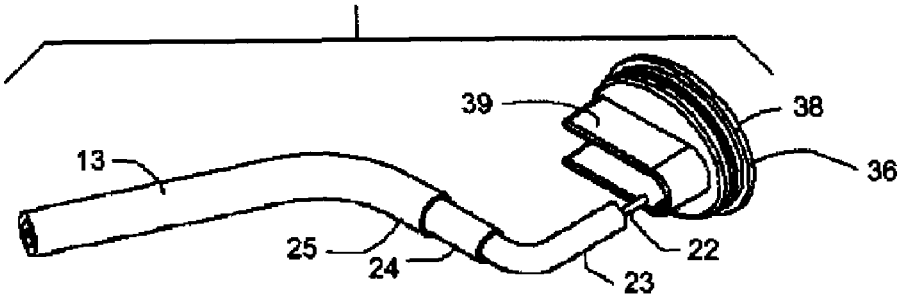

PRESSED IN CABLE TRANSITION AND METHOD

This application claims the benefit under 35 U.S.C. §119 (e) of the U.S. provisional patent application No. 61/024,272 filed Jan. 29, 2008.

TECHNICAL FIELD

The present invention relates to coaxial cable transitions and more particularly to a pressed in cable transition that connects an outer coaxial cable ground to a conductive groundplane, and method.

BACKGROUND ART

A coaxial cable is typically used for the connection between a radio frequency (RF) antenna circuit for an antenna and an RF radio device. To increase the gain of the antenna a groundplane or reflector is typically placed a selected distance behind the antenna. The placement of the groundplane behind the antenna results in a directive radiation pattern forwardly from the antenna. Generally the outer conductive braid or shielding of the coaxial cable is conductively connected to the groundplane and the center conductor of the coaxial cable is connected to the antenna circuit.

One prior known transition from the coaxial cable ground to the groundplane is a flange mount connector that is mechanically attached to the groundplane with miniature screws or rivets. Such transitions are relatively complex, relatively expensive, relatively labor intensive to install and relatively high profile.

Other prior known transitions include soldering and mechanically strapping the outer conductive braid of the coaxial cable to the groundplane. These transitions can have inconsistent electrical connections to the groundplane and are relatively labor intensive to install.

Another prior known transition is a cylindrical sleeve. The end of the coaxial cable is inserted through the sleeve. The outer coaxial braid is soldered or mechanically crimped to the sleeve. The cable center conductor and dielectric continue through and beyond the cylindrical sleeve. A portion of the cylindrical sleeve has external threads and the sleeve is mechanically attached to the groundplane with one or two threaded nuts. The coaxial cable dielectric and center conductor are trimmed to allow the center conductor to be soldered to the antenna circuit. These transitions can have inconsistent electrical connections to the groundplane, and are relatively complex and relatively labor intensive to install. The coaxial cable extends perpendicular to the groundplane and a low profile transition is not possible with this type of transition. If a nut loosens in the field, the connection to the groundplane will deteriorate with this type of transition.

DISCLOSURE OF THE INVENTION

A transition for connection of a coaxial cable to an antenna includes a hollow sleeve portion and a base at one end of the sleeve portion. The sleeve portion is generally cylindrical and sized to receive the outer conductive braid of the coaxial cable. The base is sized and shaped to press fit into a selected size aperture in the groundplane of the antenna such that the groundplane material flows around the base to form a permanent mechanical and electrical connection. The cable is prepared for assembly such that the inner conductor extends beyond the inner insulator, the inner insulator extends beyond the outer conductor, and the outer conductor extends beyond the outer insulator. The outer conductor is inserted into the sleeve portion and soldered, and the base is pressed into the groundplane. The inner conductor is soldered to the antenna circuit. Another transition for connection of a coaxial cable to an antenna includes a base and a channel portion extending across the base. The base is sized and shaped to press fit into a selected size aperture in the groundplane of the antenna such that the groundplane material flows around the base to form a permanent mechanical and electrical connection. The channel portion is generally semicylindrical and is open at one end. An aperture sized to receive the inner insulator of the cable extends through the base at the other end of the channel portion. The outer conductor of the cable is soldered to the channel portion, the base is pressed into the groundplane. The inner conductor is soldered to the antenna circuit. The method includes the steps of providing the transition, pressing the transition into the transition aperture and connecting the outer conductor to the transition.

BRIEF DESCRIPTION OF THE DRAWINGS

Details of this invention are described in connection with the accompanying drawings that bear similar reference numerals in which:

FIG. 9 is a front elevation view of FIG. 6.

FIG. 10 is partial cross sectional view taken along line 10-10 of FIG. 9.

FIG. 11 is an exploded view of the transition and cable of FIG. 5.

DETAILED DESCRIPTION OF THE INVENTION

Figure 1:
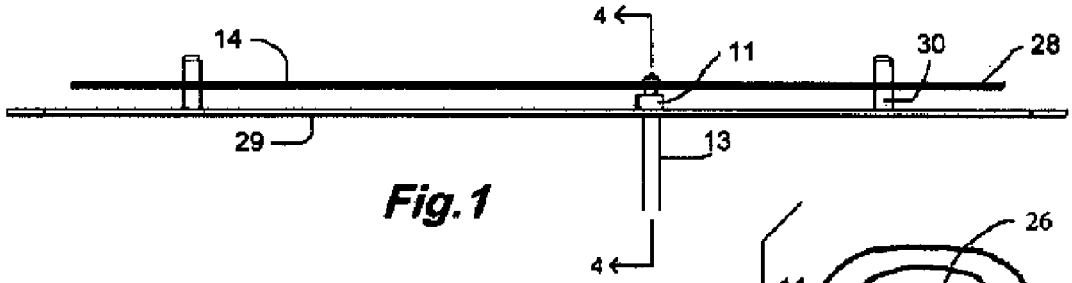
FIG. 1 is a side elevation view of an antenna connected to a coaxial cable by a transition embodying features of the present invention.
Figure 2:
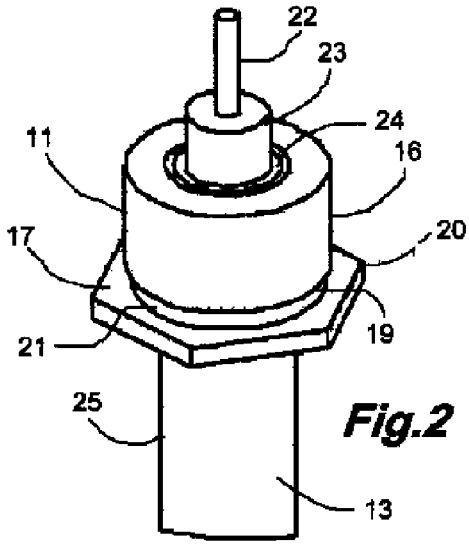
FIG. 2 is a perspective view of the transition and cable of FIG. 1.
Figure 3:
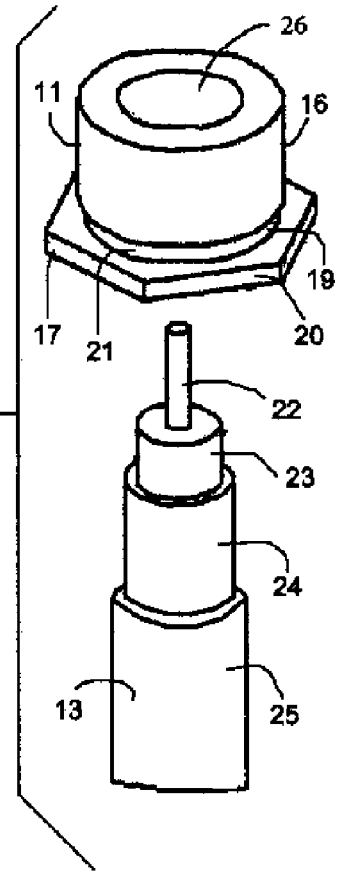
FIG. 3 is an exploded view of the transition and cable of FIG. 1.

Referring now to FIGS. 1-4, a transition 11 for connecting a coaxial cable 13 to an antenna 14, embodying features of the present invention, includes a sleeve portion 16 and a base 17 at one end of the sleeve portion 16. The sleeve portion 16 has a cylindrical shape. The base 17 has a cylindrical first portion 19 connected to the sleeve portion 16 and a second portion 20 connected to the first portion 19 opposite the sleeve portion 16. The first portion 19 shown has a selected outer diameter less than the outer diameter of the sleeve portion 16. The second portion 20 shown has a hexagonal shape of a selected size greater than the outer diameter of the sleeve portion 16 so that a groove 21 is formed between the sleeve portion 16 and the second portion 20. A base aperture 26 extends through the sleeve portion 16, the first portion 19 and the second portion 20.

The coaxial cable 13 has an inner conductor 22, an inner insulator 23 around the inner conductor 22, an outer conductor 24 around the inner insulator 23, and an outer insulator 25 around the outer conductor 24. The coaxial cable 13 is prepared with the inner conductor 22 extending beyond the inner insulator 23, the inner insulator 23 extending beyond the outer conductor 24, and the outer conductor 24 extending beyond the outer insulator 25. The outer conductor 24 is inserted into the base aperture 26 of the transition 11, with the inner conductor and insulator 22 and 23 extending beyond the transition 11. The outer conductor 24 is soldered to the interior of the sleeve portion 16 of the transition 11. The sleeve portion 16 is a means for connecting the outer conductor 24 to the base 17.

Figure 4:
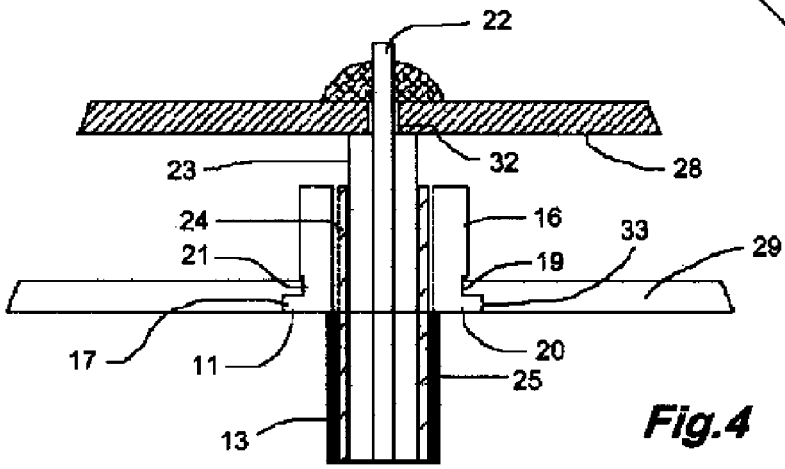
FIG. 4 is a partial cross sectional view taken along line 4-4 of FIG. 1.
Figure 5:
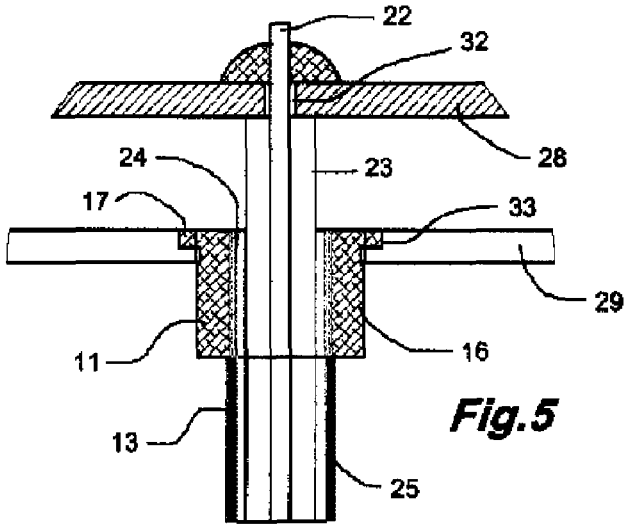
FIG. 5 is a partial cross sectional view taken along line 4-4 of FIG. 1 with the sleeve portion of the transition extending away from the antenna.
Figure 6:
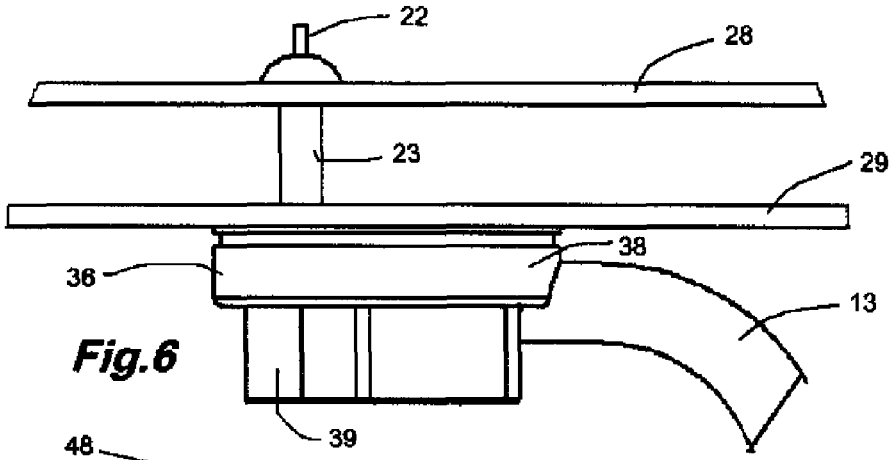
FIG. 6 is a partial side elevation view of an antenna connected to a coaxial cable by another transition embodying features of the present invention.
Figure 7:
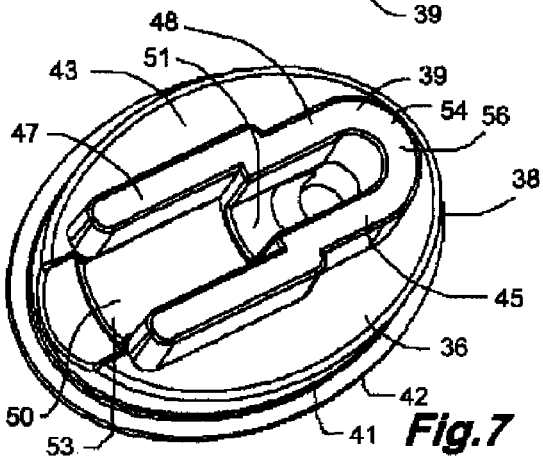
FIG. 7 is a bottom perspective view of the transition of FIG. 6.
Figure 8:
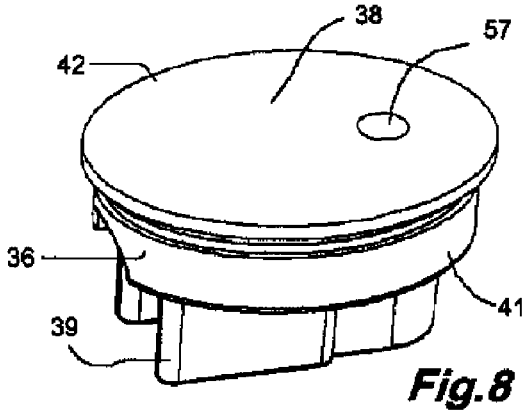
FIG. 8 is a top perspective view of the transition of FIG. 6.

The antenna 14 has an antenna circuit 28 and a groundplane 29 spaced from the antenna circuit 28 by standoffs 30. The antenna circuit 28 includes an antenna aperture 32 sized to receive the inner conductor 22. The groundplane 29 has a transition aperture 33 that is aligned with the antenna aperture 32. Generally the groundplane 29 is made of metal such as aluminum. Prior to assembly of the transition 11, the first portion 19 of the base 17 has a selected size that is smaller than the size of the transition aperture 33 and the second portion 20 has a selected size larger than the size of the transition aperture 33. The first and second portions 19 and 20 of the base 17 are sized such that when the base 17 is pressed into the transition aperture 33, the second portion 20 forces the material of the groundplane 29 to flow into the groove 21 and against the first portion 19. After the base 17 is pressed into the transition aperture 33, the groundplane 29 contacts the base 17 along the entire periphery of the second portion 20, and at least a portion of the periphery and preferably the entire periphery of the first portion 19. In FIG. 4 the sleeve portion 16 projects from the groundplane 29 toward the antenna circuit 28, and in FIG. 5 the sleeve portion 16 projects away from the groundplane 29 toward the antenna circuit 28. The inner conductor 22 projects through the antenna aperture 32 and is soldered to the antenna circuit 28.

The method includes the steps of providing a transition 11 having a base 17, pressing the base 17 into the transition aperture 33, and connecting the outer conductor 24 to the transition 11. The base 11 has a first portion 19 sized smaller than the transition aperture 33 and a second portion 20 sized larger than the transition aperture 33. The base 17 is pressed into the transition aperture 33 such that the second portion 20 forces the groundplane 29 to flow inwardly against the first portion 19.

FIGS. 6-11 show another transition 36, embodying features of the present invention, including a base 38 and a channel portion 39. The base 38 has a first portion 41 and a second portion 42 having a smaller outer dimension than the first portion 41. The first and second portions 41 and 42 shown are oval, but can also be round or other shapes. The first portion 41 has an outwardly facing face 43, opposite the second portion 42.

The channel portion 39 includes two spaced side walls 45 that project from the face 43 of the first portion 41 of the base 38. The channel portion 39 has a first section 47 and a second section 48 connected to the first section 47. The side walls 45 at the first section 47 are spaced apart the diameter of the outer conductor 24 of the coaxial cable 13, and the side walls 45 at the second section 48 are spaced apart the diameter of the inner insulator 23. The first section 47 has a semi-cylindrical first inner surface 50, relieved into the face 43 of the first portion 41 of the base 38, with a diameter equal to the diameter of the outer conductor 24. The second section 48 has a semi-cylindrical second inner surface 51, relieved into the face 43 of the first portion 41 of the base 38, with a diameter about equal to the diameter of the inner insulator 23.

The channel portion 39 has an open first end 53, at the end of the first section 47 that is opposite the second section 48. The channel portion 39 has a closed second end 54 formed by an end wall 56 that extends between the side walls 45 at the end of the second section 48 opposite the first section 47. A base aperture 57 extends from the second section 48, adjacent to the end wall 56, through the base 38. The base aperture 57 is sized to receive the inner insulator 23 of the coaxial cable 13. A hood can also cover the channel portion 39.

The cable 13 is prepared as described above and assembled to the transition 36 with the outer conductor 24 in the first section 47 of the channel portion 39, the inner insulator 23 extending through the second section 48 of the channel portion 39 and through the base aperture 57, and the inner conductor 22 projecting beyond the base 38. The outer conductor 24 is soldered to the first section 47 of the channel portion 39. The channel portion 39 is a means for connecting the outer conductor 24 to the base 38. The base 38 of the transition 36 is pressed into the transition aperture 33 with the inner conductor 22 extending through the antenna aperture 32. The inner conductor 22 is soldered to the antenna circuit 28.

The transition 1l1 provides a low cost, simple, permanent electrical and mechanical connection of the coaxial cable 13 to the antenna 14. The transition 36 provides a low cost, simple, permanent, low profile connection of the coaxial cable 13 to the antenna 14. Although the transitions 11 and 36 are disclosed as connecting the coaxial cable 13 to an antenna 14, the transitions 11 and 36 can be used to provide a low cost, simple, permanent connection between the outer conductor 24 of the coaxial cable 13 and other ground structure or other electrically conductive metal parts. By way of example, and not as a limitation, the transitions 11 and 36 can be used to provide a low cost, simple, permanent connection between the outer conductor 24 of the coaxial cable 13 and a metallic housing.

Although the present invention has been described with a certain degree of particularity, it is understood that the present disclosure has been made by way of example and that changes in details of structure may be made without departing from the spirit thereof.

What is claimed is:

1. A transition for connecting an outer conductor of a coaxial cable to a conductive metal part having a transition aperture, comprising:

a base having a first portion sized smaller than said transition aperture and a second portion sized larger than said transition aperture, said first and second portions being sized such that when said base is pressed into said transition aperture, said second portion forces said metal part to flow inwardly against said first portion, and means for connecting said outer conductor to said base, whereby when said base is pressed into said transition aperture, said metal part is permanently mechanically and electrically connected along at least a portion of the periphery of said first and second portions of said base.

2. The transition as set forth in claim 1 wherein said first and second portions are sized such that when said base is pressed into said transition aperture, said second portion forces said metal part to flow inwardly to contact the entire periphery of said first portion.

3. The transition as set forth in claim 1 wherein said means for connecting includes a sleeve portion connected to said first portion of said base, and a base aperture that extends though said sleeve portion, said first portion and said second portion, said base aperture being sized to receive said outer conductor, whereby said outer conductor is inserted into said base aperture and soldered to said sleeve portion to connect said outer conductor to said base.

4. The transition as set forth in claim 3 wherein said sleeve portion has a larger periphery than said first portion of said base to form a groove between said sleeve portion and said second portion of said base, whereby when said base is pressed into said transition aperture, said second portion forces said metal part to flow inwardly into said groove.

5. The transition as set forth in claim 1 wherein said means for connecting includes a channel portion that extends across said first portion of said base with an open first end and a spaced, closed second end, and a base aperture at said second end, transverse to said channel portion, that extends through said first and second portions of said base, said channel portion being sized to receive said outer conductor and said base aperture being sized to receive an inner insulator of said coaxial cable, whereby said outer conductor is soldered to said channel portion to connect said outer conductor to said base.

6. The transition as set forth in claim 1 wherein said second portion of said base is polygonal.

7. The transition as set forth in claim 1 wherein said second portion of said base is hexagonal.

8. The transition as set forth in claim 7 wherein said first portion of said base is round.

9. The transition as set forth in claim 1 wherein said first and second portions of said base are oval.

10. A transition for connecting an outer conductor of a coaxial cable to a conductive metal part having a transition aperture, comprising:

a base having a round first portion sized smaller than said transition aperture and a hexagonal second portion sized larger than said transition aperture, said first and second portions being sized such that when said base is pressed into said transition aperture, said second portion forces said metal part to flow inwardly against said first portion, and a sleeve portion connected to said first portion of said base and having a base aperture that extends though said sleeve portion, said base aperture extending through said first and second portions, said base aperture being sized to receive said outer conductor, said sleeve portion having a larger periphery than said first portion of said base to form a groove between said sleeve portion and said second portion of said base, whereby when said base is pressed into said transition aperture, said metal part flows into said groove to permanently mechanically and electrically connect said base and said metal part.

11. A transition for connecting an outer conductor of a coaxial cable to a conductive metal part having a transition aperture, comprising:

a base having a first portion sized smaller than said transition aperture, a second portion sized larger than said transition aperture and a base aperture that extends through said first and second portions of said base, said first and second portions being sized such that when said base is pressed into said transition aperture, said second portion forces said metal part to flow inwardly against said first portion, said base aperture being sized to receive an inner insulator of said coaxial cable, and a channel portion that extends across said first portion of said base transverse to said base aperture, said channel portion having an open first end and a spaced, closed second end at said base aperture, said channel portion being sized to receive said outer conductor, whereby when said base is pressed into said transition aperture, said metal part is permanently mechanically and electrically connected along at least a portion of the periphery of said first and second portions of said base.

* * * * *